US008533908B2

(12) United States Patent
Scicluna

(10) Patent No.: US 8,533,908 B2
(45) Date of Patent: Sep. 17, 2013

(54) BALL WHEEL

(75) Inventor: Paul Scicluna, Penndel, PA (US)

(73) Assignee: Tumi, Inc., South Plainfield, NJ (US)

( * ) Notice: Subject to any disclaimer, the term of this patent is extended or adjusted under 35 U.S.C. 154(b) by 430 days.

(21) Appl. No.: 13/005,270

(22) Filed: Jan. 12, 2011

(65) Prior Publication Data

US 2012/0175853 A1 Jul. 12, 2012

(51) Int. Cl.
*B60B 33/08* (2006.01)

(52) U.S. Cl.
USPC ..... 16/24; 16/25; 16/26

(58) Field of Classification Search
USPC ..... 16/18 CG, 21, 24, 25, 26, 27, 45
See application file for complete search history.

(56) References Cited

U.S. PATENT DOCUMENTS

| | | | | | |
|---|---|---|---|---|---|
| 640,499 | A * | 1/1900 | Stilwell | 16/21 |
| 1,265,850 | A * | 5/1918 | Wierszewska | 16/26 |
| 1,368,465 | A * | 2/1921 | Sutliffe | 16/46 |
| 1,546,775 | A * | 7/1925 | Bryant | 301/5.7 |
| 2,173,950 | A * | 9/1939 | Parkhill | 16/21 |
| 2,451,353 | A | 10/1948 | Newell | |
| 2,659,926 | A * | 11/1953 | Wein | 16/24 |
| 2,779,965 | A * | 2/1957 | Schilberg | 16/26 |
| 5,393,079 | A | 2/1995 | Wang et al. | |
| 5,794,744 | A | 8/1998 | Lin et al. | |
| 7,065,828 | B2 * | 6/2006 | Sorensen | 16/45 |
| 7,647,673 | B2 * | 1/2010 | Melara | 16/35 R |

FOREIGN PATENT DOCUMENTS

| | | |
|---|---|---|
| GB | 2 231 371 | 11/1990 |
| JP | 2005-075328 | 3/2005 |
| WO | WO 87/06536 | 11/1987 |

* cited by examiner

*Primary Examiner* — Roberta Delisle
(74) *Attorney, Agent, or Firm* — Jon Fallon, Esq.

(57) ABSTRACT

A ball wheel assembly including a wheel ball is provided. The assembly further includes first and second legs. The legs include a mounting portion and a ring-shaped leg cover. The legs are secured together proximate to the mounting portions. The legs further include a leg ball bearing retaining ring and leg ball bearings. The leg ball bearing retaining ring and leg ball bearings are positioned between the leg cover and the wheel ball. The assembly further includes a top housing. The top housing includes a top housing cover, a housing ball bearing retaining ring, and housing ball bearings. The top housing is secured to the legs, and the housing ball bearing retaining ring and housing ball bearings are positioned between the top housing cover and the wheel ball.

25 Claims, 7 Drawing Sheets

BALL WHEEL

FIELD OF THE INVENTION

The disclosed subject matter relates to a ball wheel assembly and a method of assembly thereof, and in particular to a ball wheel assembly for mounting on a piece of luggage.

BACKGROUND

Wheeled luggage cases are in widespread use today and greatly ease the traveler's movement in airports, railroad stations, etc. Many wheeled luggage items have retractable handles, which permit the traveler to pull or push the luggage item as he walks and have one hand free, and a number of wheels on which the luggage can roll. The wheels for wheeled luggage can typically pivot about an axis substantially perpendicular to a bottom surface of the luggage and facilitate movement of the luggage by rolling in the direction of the traveler's movement.

Wheels for wheeled luggage should provide the desired mobility while being rugged enough to withstand the wear and tear of normal use. A wheel assembly for luggage that attempts to address these issues is described in U.S. Pat. No. 5,393,079 to Wang. Wang describes a wheeled luggage assembly in which an L-shaped member is attached to the bottom of a body portion and an axle is disposed on the L-shaped member. Separate wheel protectors are fitted in recesses of the body portion and wheels are pivotally connected with the end of the axle. In another example attempting to address these issues, U.S. Pat. No. 5,794,744 to Lin describes a wheel assembly, which comprises a first subassembly and a second subassembly respectively mounted on an exterior side and an interior side of a frame of a luggage such that a space is formed between the first subassembly and the second subassembly for a wheel mount installed therein. The first subassembly and the second subassembly respectively include a central wheel well. A shaft has an end thereof screwed to the wheel mount and the other end thereof extending into the wheel well. A wheel is received in the central wheel well of the first subassembly and pivoted to the shaft for rotating, its distal end thereof pivoted to the wheel mount such that the wheel can turn freely.

Nevertheless, there remains a need for a wheel assembly for luggage that is mobile, rugged, and can be manufactured easily.

SUMMARY

The purpose and advantages of the disclosed subject matter will be set forth in and are apparent from the description that follows, as well as will be learned by practice of the disclosed subject matter. Additional advantages of the disclosed subject matter will be realized and attained by the methods and systems particularly pointed out in the written description and claims hereof, as well as from the appended drawings.

To achieve these and other advantages and in accordance with the purpose of the disclosed subject matter, as embodied and broadly described, the disclosed subject matter includes a ball wheel assembly. The ball wheel assembly includes a wheel ball and first and second legs. The legs include a mounting portion and a ring-shaped leg cover. The legs are secured together proximate to the mounting portions. The legs further include a leg ball bearing retaining ring and leg ball bearings. The leg ball bearing retaining ring and leg ball bearings are positioned between the leg cover and the wheel ball. The leg cover has an inner circumference defining an inner diameter and an outer circumference defining an outer diameter, and the inner diameter is between about one-half to about three-fourths, and preferably about two-thirds, the outer diameter. The leg cover has an inner surface, and the inner surface is concave relative to the wheel ball. The assembly further includes a top housing. The top housing includes a top housing cover, a housing ball bearing retaining ring, and housing ball bearings. The top housing is secured to the legs, and the housing ball bearing retaining ring, and housing ball bearings are positioned between the top housing cover and the wheel ball.

In some embodiments, the dimensions of the first and second legs can be identical. The first and second legs can be secured together with fasteners. The fasteners can be screws. The first and second legs can have mounting holes. Each mounting hole can be formed to securably receive the fasteners.

In some embodiments, only one of the first and second legs can have mounting holes. Each mounting hole can be formed to securably receive the fasteners.

In some embodiments, the first and second legs can each have a mounting hole formed to securably receive a fastener and a further mounting hole formed to allow a further fastener to pass through the further mounting hole.

In some embodiments, the inner surface of the leg cover can have a curvature approximately equal to a curvature of the wheel ball.

In some embodiments, the leg cover can be positioned to provide a spacing between the leg cover and the wheel ball to permit dirt to escape from between the leg cover and the wheel ball. The spacing can be defined by a diameter of the leg ball bearings. Each leg ball bearing can be spaced apart a distance of about 2 mm from a proximate leg ball bearing at a minimum.

In some embodiments, a cross-section of the wheel ball coplanar with the outer circumference of the leg cover can have a diameter between about one-half to about five-sixths the diameter of the wheel ball, and preferably about three-fourths the diameter of the wheel ball.

In some embodiments, the top housing cover includes an outer cover portion and an inner mounting portion. The top housing can be secured to the legs with fasteners through the top housing cover and the mounting portions. The outer cover portion can be made of plastic. The inner mounting portion can be made of forged aluminum. The inner mounting portion can be a skid.

The disclosed subject matter also includes a method of assembling a ball wheel. The method includes positioning first and second legs on opposite sides of a wheel ball and positioning first and second leg bearing retaining rings and first and second leg ball bearings between first and second leg covers and the wheel ball. The method also includes securing the first and second legs together proximate to a mounting portion and positioning a housing ball bearing retaining ring and housing ball bearings between a top housing cover and the wheel ball. The method also includes securing the top housing cover to the first and second legs.

The disclosed subject matter also includes a piece of luggage. The piece of luggage includes a luggage body and at least two ball wheels according to the disclosed subject matter. The two ball wheels are positioned on a surface of the luggage body along a first side.

In some embodiments, the piece of luggage can include two feet positioned along a second side opposite the first side.

The piece of luggage can include two further ball wheels positioned along a second side opposite the first side.

DETAILED DESCRIPTION

Reference will now be made in detail to the exemplary embodiments of the disclosed subject matter, an example of which is illustrated in the accompanying drawings. The device and method of the disclosed subject matter will be described in conjunction with the detailed description of the system.

As disclosed herein, the devices and methods presented can be used for making and using a ball wheel for a piece of luggage.

For the purpose of explanation and illustration, and not limitation, an exemplary embodiment is shown in FIGS. 1-6. Particularly and as illustrated, the ball wheel assembly 100 consists of a wheel ball 110, first and second legs 126, 136, and a top housing 142.

Figure 1:
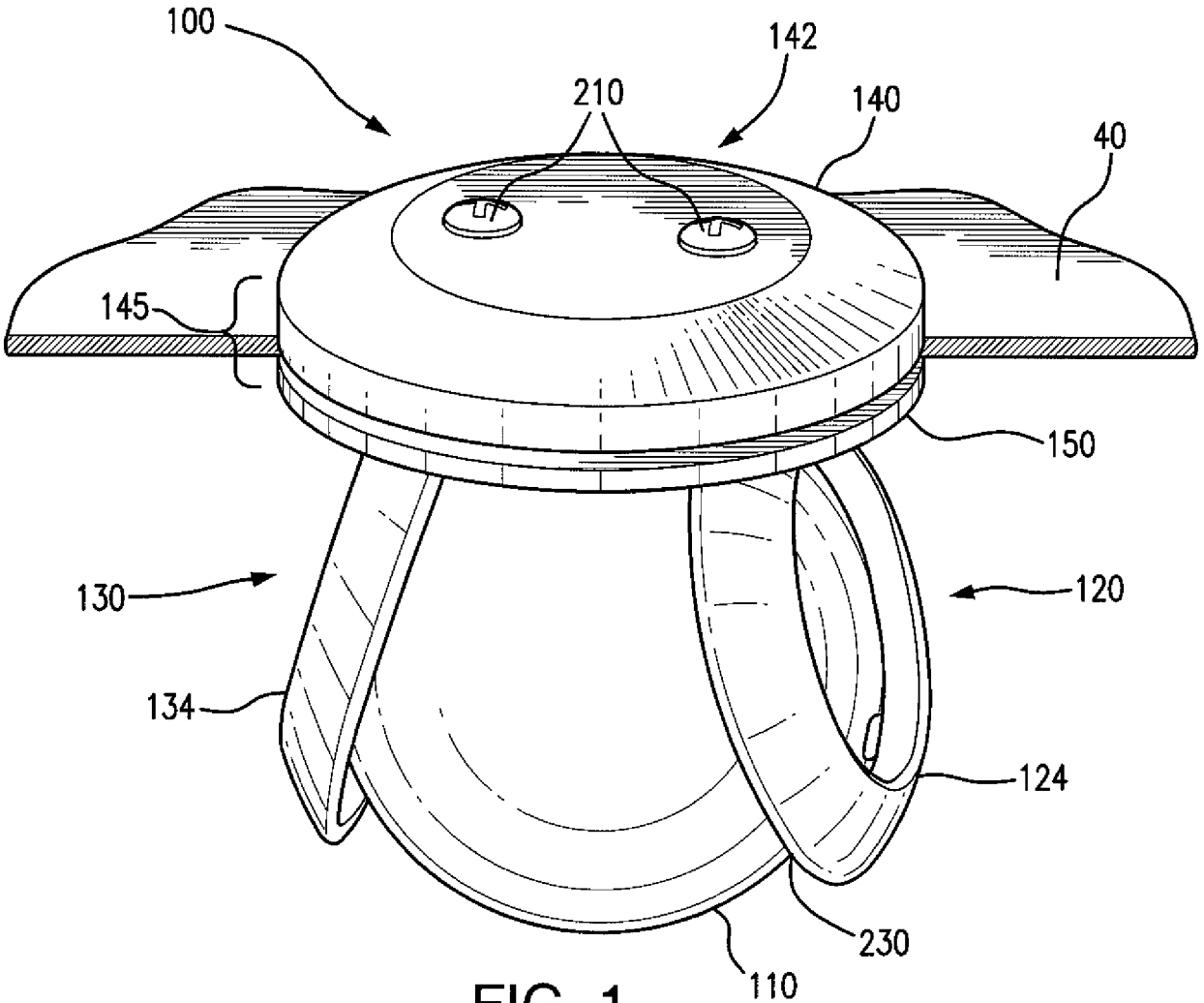
FIG. 1 is a perspective view of an exemplary embodiment of a ball wheel assembly according to the disclosed subject matter.
Figure 4:
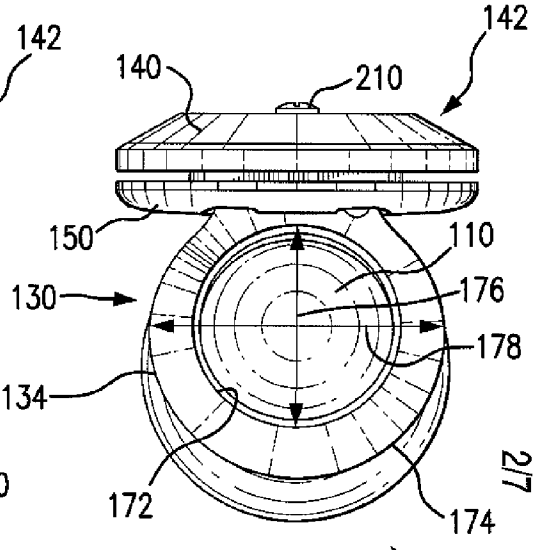
FIG. 4 is a side view of the ball wheel assembly.
Figure 3:
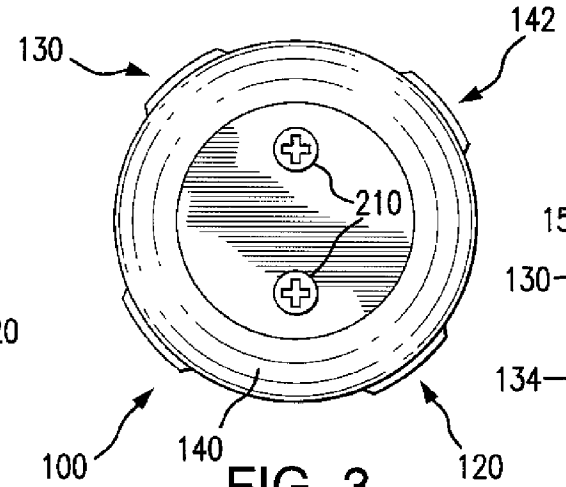
FIG. 3 is a top view of the ball wheel assembly.
Figure 5:
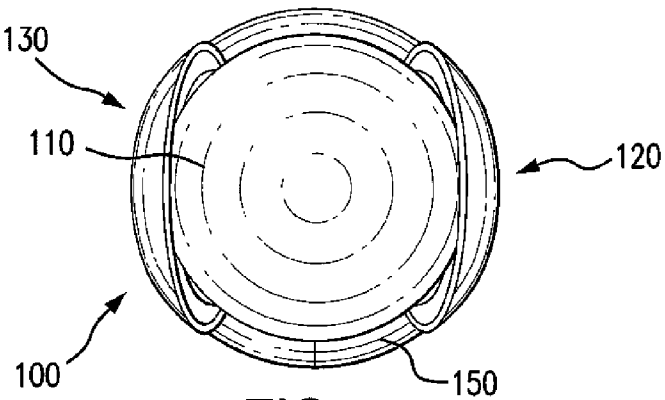
FIG. 5 is a bottom view of the ball wheel assembly.
Figure 2:
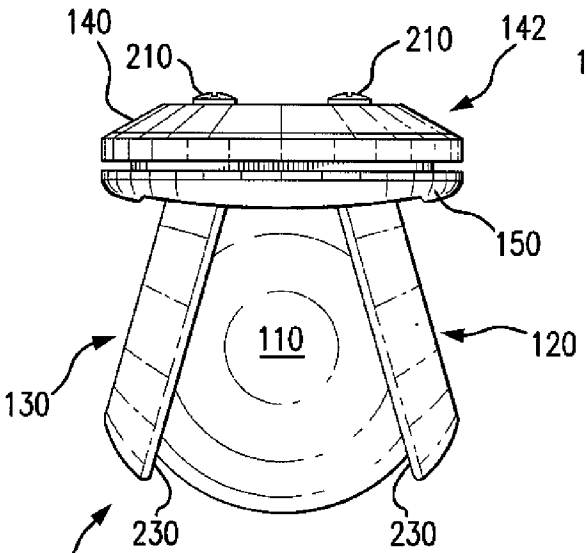
FIG. 2 is a front view of the ball wheel assembly.
Figure 6:
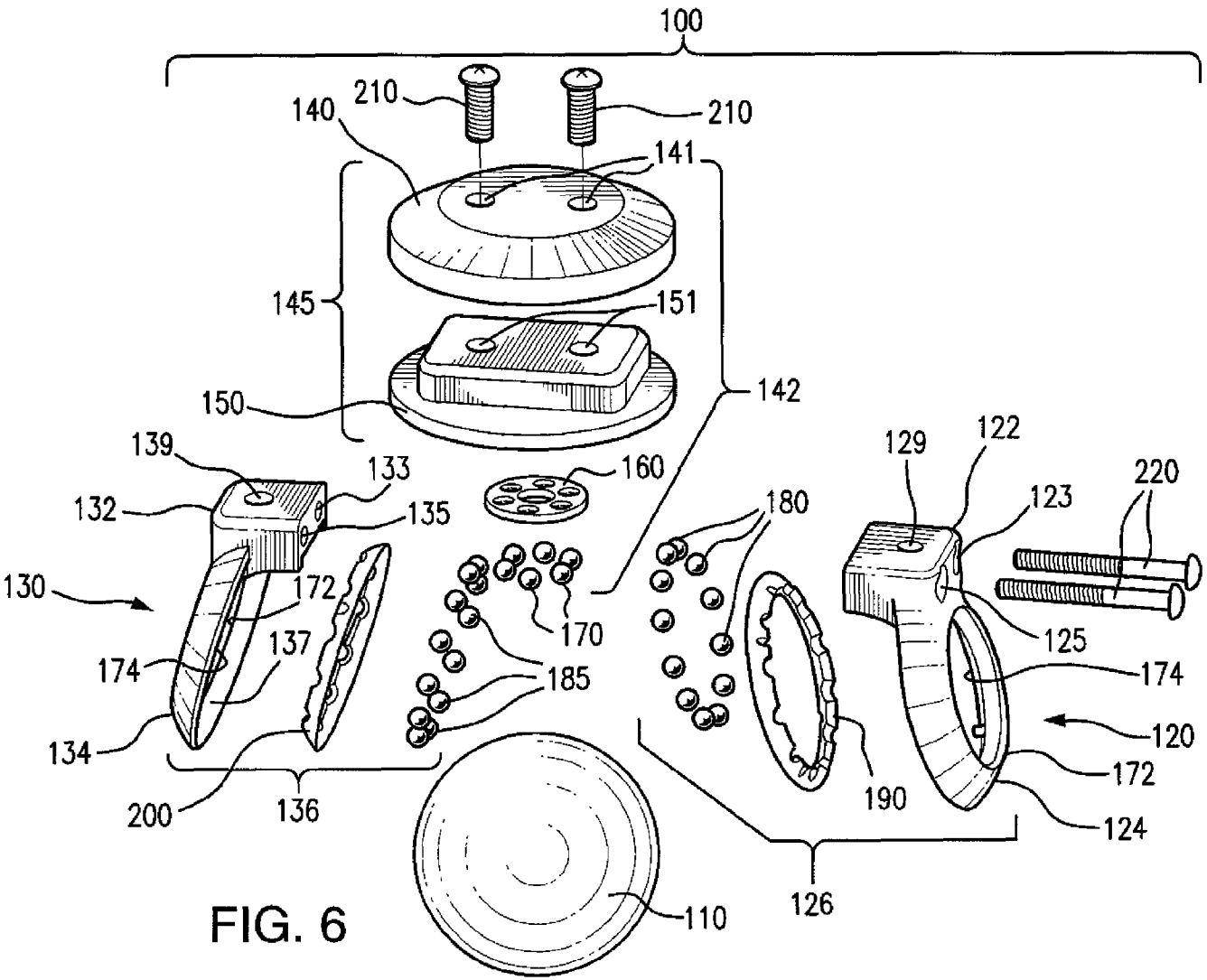
FIG. 6 is an exploded schematic view of the ball wheel assembly.

As shown in FIG. 6, for example, the first and second legs 126, 136 each includes a leg housing 120, 130. Each leg housing has a mounting portion 122, 132 and a ring-shaped leg cover 124, 134. The ring-shaped leg cover 124, 134 has an inner circumference 172 and an outer circumference 174 defining an inner diameter 176 and an outer diameter 178, respectively. The inner diameter 176 can be between about ½ to about ¾ the outer diameter 178, and preferably about ⅔ the outer diameter 178. The ring-shaped leg cover 124, 134 can be angled so as to flare out from a line perpendicular to top housing 142, preferably about 20 degrees. The angling allows for the top housing 142 to have a potentially smaller diameter or footprint.

When the top housing 142 is parallel to the ground, e.g., when all four wheel balls 110 are in contact with the ground, there should be about ¾ inches to ⅜ inches clearance between the ground and a portion of the leg cover 124, 134 closest to the ground so that when the luggage 10 is pulled with only two wheel balls 110 in contact with the ground, typically with the luggage at an angle of about 40 degrees to 55 degrees, the leg cover 124, 134 will not be in contact with the ground.

The first and second legs 126, 136 are secured together proximate to the mounting portions 122, 132. The first and second legs 126, 136 can be secured together with fasteners 220. For example and without limitation, the fasteners 220 can be screws or any other suitable fastener. The first and second legs 126, 136 can be identical. The first and second legs 126, 136 can have mounting holes 123, 125, 133, 135 that are formed, for example by having threading, to securably receive fasteners 220. Alternatively, only one of the first and second legs 126, 136 can have mounting holes 123, 125, 133, 135 that are formed, for example by having threading, to securably receive fasteners 220. In this embodiment, the opposing leg 126, 136 can have mounting holes that allow fasteners 220 to pass through the mounting hole, for example by not having threading. In another embodiment, only one of the mounting holes 123, 125, 133, 135 for each of the first and second legs 126, 136, can be formed, for example by having threading, to securably receive fasteners 220, with the opposite hole 123, 125, 133, 135 allowing fasteners 220 to pass through the mounting hole, for example by not having threading.

The first and second legs 126, 136 each also includes a leg ball bearing retaining ring 190, 200 and leg ball bearings 180, 185. The leg ball bearing retaining ring 190, 200 and leg ball bearings 180, 185 are positioned between the leg cover 124, 134 and the wheel ball 110. The leg cover 124, 134 can have an inner surface 137 that is concave relative to the wheel ball 110. The leg covers 124, 134 can be positioned to provide a spacing to permit dirt to escape from between the leg covers 124, 134 and the wheel ball 110, and the spacing can be defined by a diameter of the leg ball bearings 180, 185. The leg ball bearings 180, 185 can be made of metal, plastic, ceramic or any other suitable material and can have diameters, for example, of between about 2 and 4 mm, and preferably about 3 mm. The spacing can also be defined by a curvature of the inner surface 137 of the leg cover 124, 134 relative to a curvature of the wheel ball 110, and the curvature of the inner surface 137 of the leg cover 124, 134 can be approximately equal to a curvature of the wheel ball 110. Further, each leg ball bearing 180, 185 can be spaced apart a distance of about 2 mm from a proximate leg ball bearing 180, 185 at a minimum. A cross-section 230 of the wheel ball 110 defined by an imaginary plane coplanar with the outer circumference 174 of the leg cover 124, 134 can have a diameter between about one-half to about five-sixths the diameter of the wheel ball 110, and preferably about three-fourths the diameter of the wheel ball 110. The first and second legs 126, 136 being secured together on opposing sides of the wheel ball 110 likewise secures the leg ball bearing retaining 190, 200 and leg ball bearings 180, 185 therebetween.

The top housing 142 includes a top housing cover 145, and optionally a housing ball bearing retaining ring 160, and housing ball bearings 170. The top housing cover 145 can include an outer cover portion 140 and an inner mounting portion 150. The outer cover portion 140 can be made of plastic or any other suitable material. The inner mounting portion 150 can be made of forged aluminum or any other suitable material including, but not limited to plastic, zinc, steel or composite, such as those containing carbon. The housing ball bearings 170 can be of similar size and material as leg ball bearings 180, 185.

The top housing 142 is secured to the legs 126, 136. The top housing 142 can be secured to the legs 126, 136 using fasteners 210. For example and without limitation, the fasteners 210 can be screws or any other suitable fastener. The outer cover portion 140 can have mounting holes 141 that are formed to receive fasteners 210. The inner mounting portion 150 can have mounting holes 151 that are formed, for example by having threading, to securably receive fasteners 210. The housing ball bearing retaining ring 160 and the housing ball bearings 170 are positioned between the top housing cover 145 and the wheel ball 110. The top housing cover 145 being secured to the legs 126, 136 and proximate to the wheel ball 110 likewise secures the housing ball bearing retaining ring 160 and the housing ball bearings 170 therebetween.

In accordance with another aspect of the disclosed subject matter, a method of assembling a ball wheel assembly 100 is provided. The method includes positioning first and second legs 126, 136 on opposite sides of a wheel ball 110. The first and second legs 126, 136 comprise first and second leg bearing retaining rings 190, 200 and first and second leg ball bearings 180, 185 positioned between first and second leg covers 124, 134 and the wheel ball 110. The method also includes securing the first and second legs 126, 136 together proximate to a mounting portion 122, 132 of each leg housing 120, 130. The method also includes positioning a housing ball bearing retaining ring 160 and housing ball bearings 170 between a top housing cover 145 and the wheel ball 110. The method also includes securing the top housing cover 145 to the first and second legs 126, 136. The ball wheel assembly 100 can include any of the features described herein above.

Figure 7:
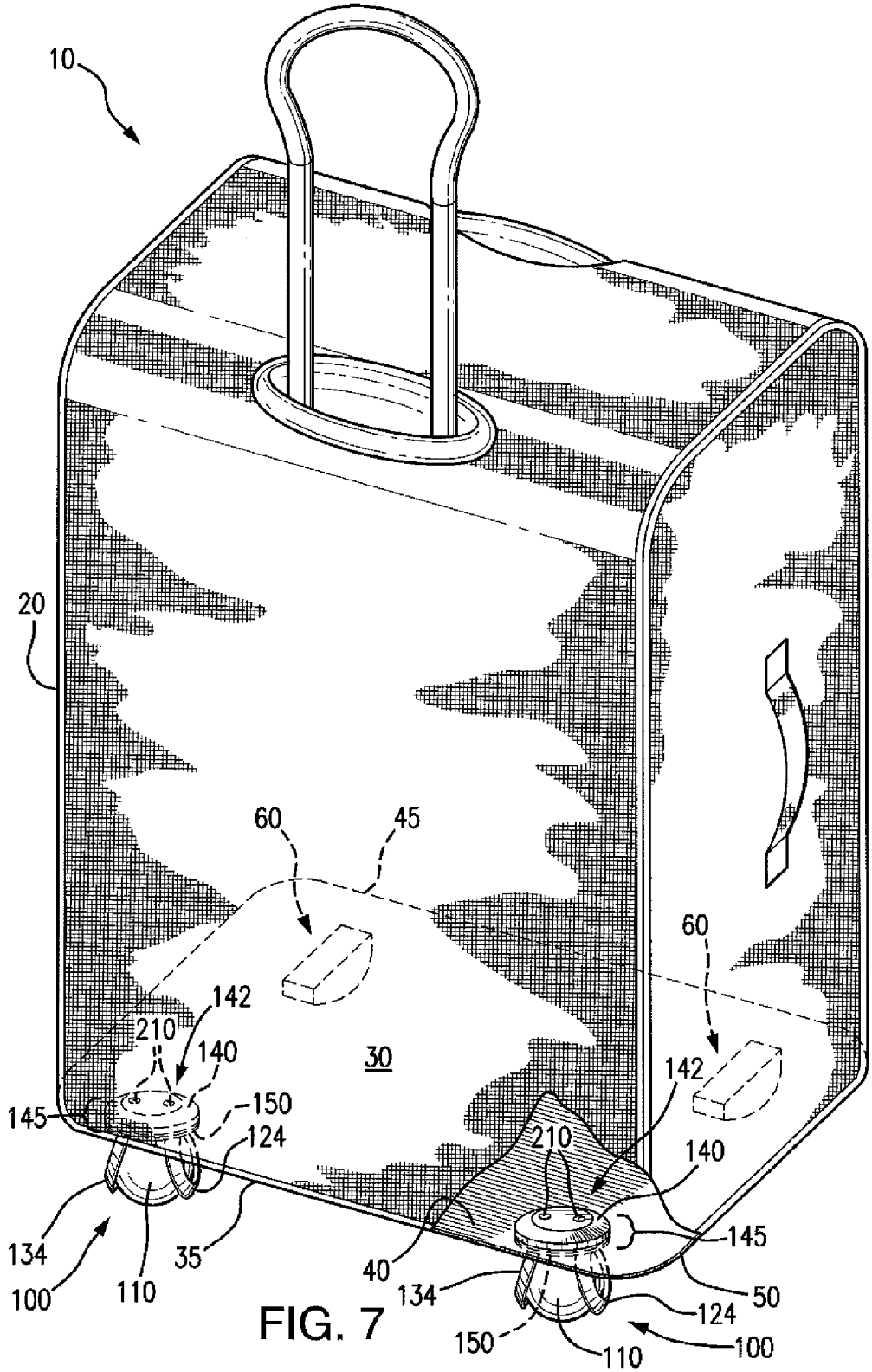
FIG. 7 is a schematic three-quarter front pictorial view of an exemplary embodiment of a piece of luggage including two ball wheel assemblies according to the disclosed subject matter, with portions broken away.

For the purpose of explanation and illustration, and not limitation, an exemplary embodiment of a piece of luggage 10 having two ball wheel assemblies 100 according to the disclosed subject matter is shown in FIG. 7. The piece of luggage 10 has a luggage body 20. The two ball wheel assemblies 100 are positioned on a face 30 of the luggage body 20 proximate to a first edge 35 of the face 30. The ball wheel assemblies 100 can be secured to the luggage body 10 by any appropriate securing means. For example and without limitation, the outer cover portion 140 of the top housing cover 145 can be placed on an inner surface 40 of the luggage body 10, opposite an outer surface 50, and the inner mounting portion 150 of the top housing cover 145 can be placed on the outer surface 50. As described above, the top housing cover 145 can be secured to the legs 126, 136 by fasteners 210 through the outer cover portion 140 and inner mounting portion 150 of the top housing cover 145, with the face 30 of the luggage body 20 secured therebetween.

The piece of luggage 10 can include a number of feet 60 positioned on the face 30 of the luggage body 20 proximate to a second edge 45 of the face 30, opposite the first edge 35. The feet 60 can be fastened to the luggage body 20 by any appropriate securing means. For example and without limitation, the feet 60 can be formed to securably receive fasteners 210, for example by having threading. The outer cover portion 140 of the top housing cover 145 can be placed on an inner surface 40 of the luggage body 10, with the inner mounting portion 150 disposed on an outer surface 50, and the feet 60 can be fastened to the inner mounting portion 150 with fasteners 210. Alternatively, the feet 60 can be fastened directly to the outer cover portion 140 with fasteners 210, with the face 30 of the luggage body 20 secured therebetween, eliminating the inner mounting portion 150. In this embodiment, the feet 60 can replace a number of ball wheel assemblies 100, while using the outer cover portion 140 or inner mounting portion 150 for mounting.

Figure 8:
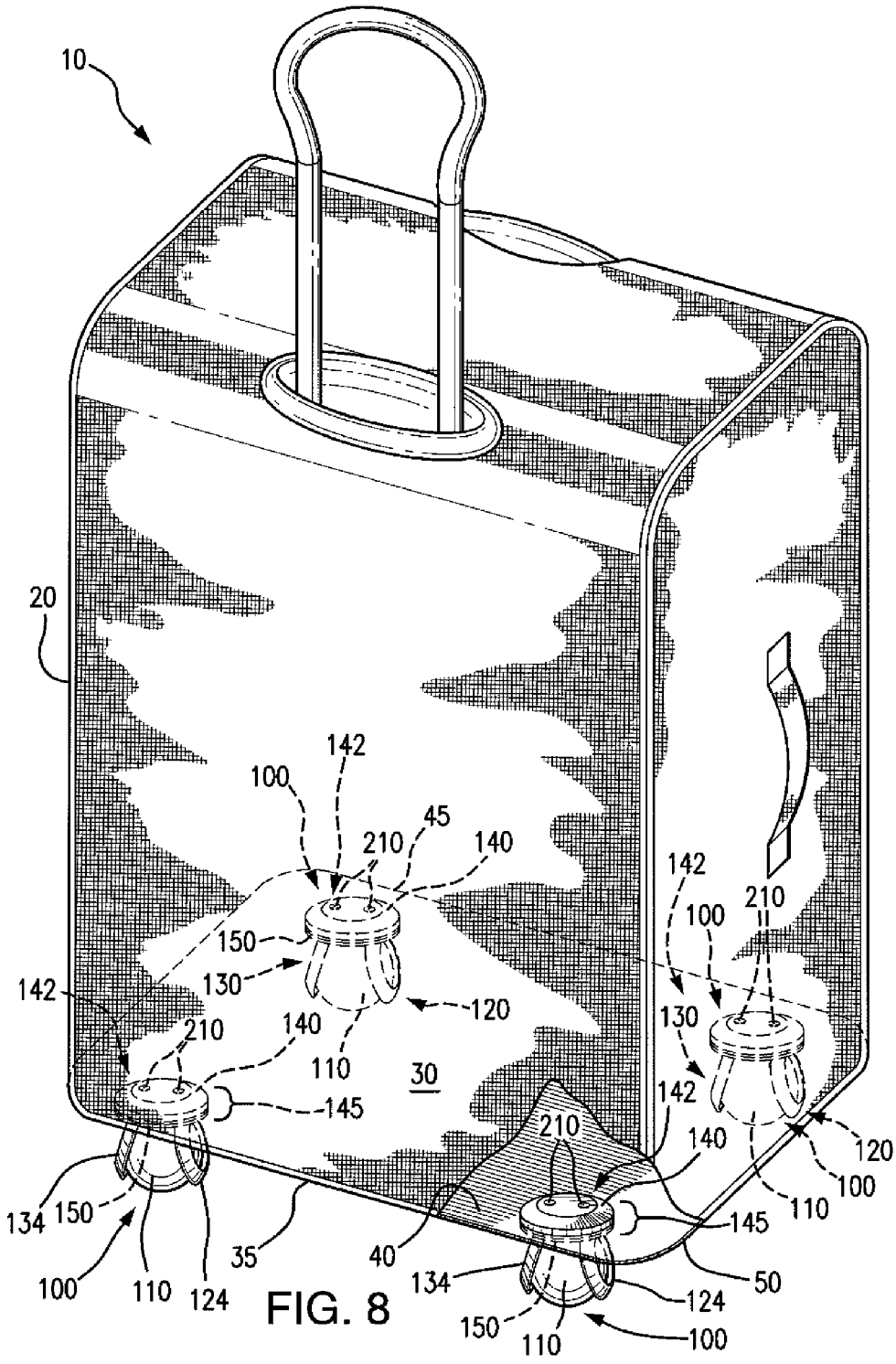
FIG. 8 is a schematic three-quarter front pictorial view of an exemplary embodiment of a piece of luggage including four ball wheel assemblies according to the disclosed subject matter, with portions broken away.

For the purpose of explanation and illustration, and not limitation, an exemplary embodiment of a piece of luggage 10 having four ball wheel assemblies 100 according to the disclosed subject matter is shown in FIG. 8. The piece of luggage 10 can include two ball wheel assemblies 100 as shown and described with respect to FIG. 7, and can include two further ball wheel assemblies 100 positioned on the face 30 of the luggage body 20 along a second side 45 opposite the first side 35. The two further ball wheel assemblies 100 can be fastened to the luggage body 20 by any appropriate securing means. For example and without limitation, the outer cover portion 140 of the top housing cover 145 can be placed on an inner surface 40 of the luggage body 10, opposite an outer surface 50, and the inner mounting portion 150 of the top housing cover 145 can be placed on the outer surface 50. As described above, the top housing cover 142 can be secured to the legs 126, 136 by fasteners 210 through the outer cover portion 140 and inner mounting portion 150 of the top housing cover 145, with the face 30 of the luggage body 20 secured therebetween.

Figure 9:
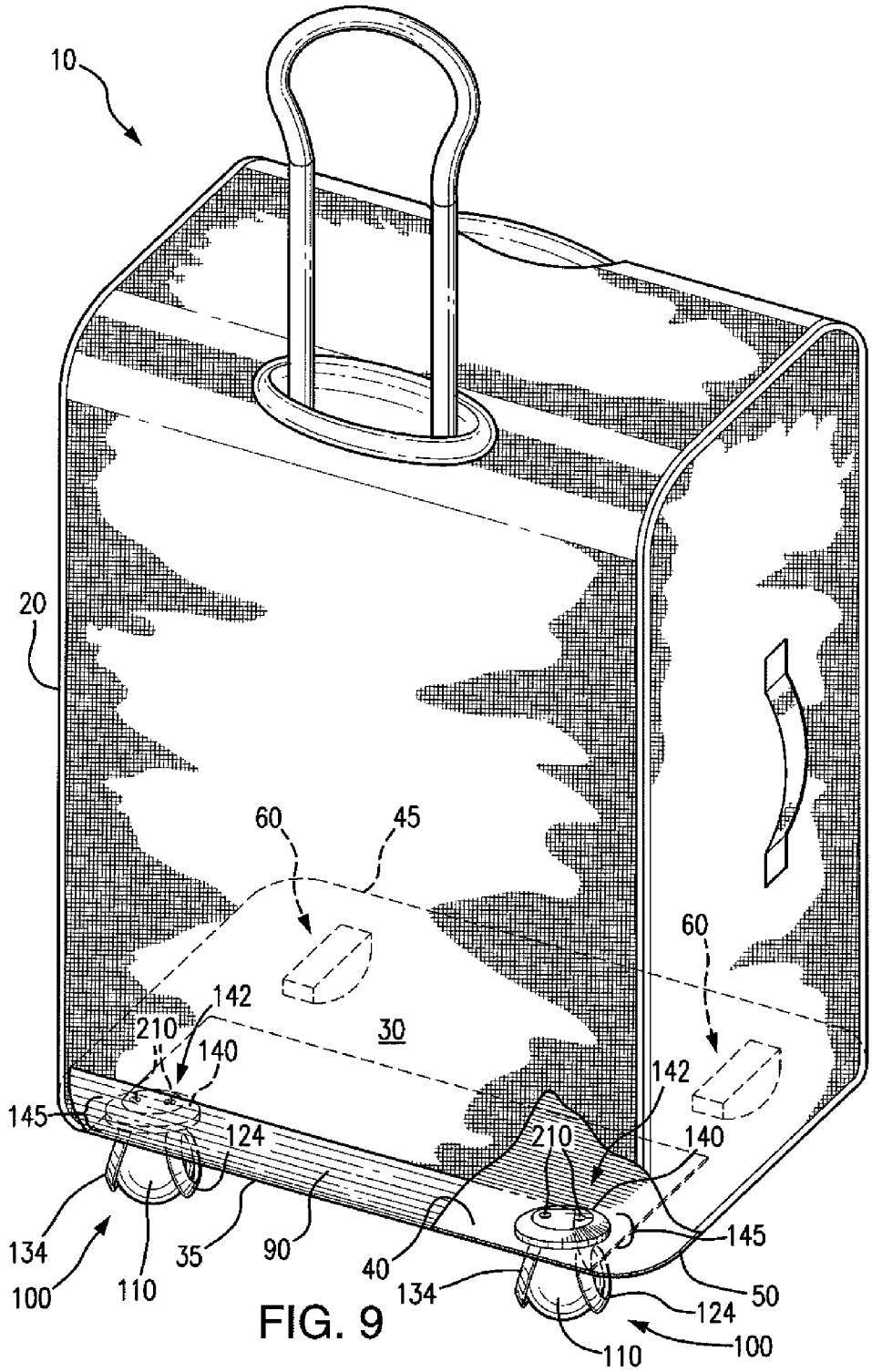
FIG. 9 is a schematic three-quarter front pictorial view of an exemplary embodiment of a piece of luggage including at least two ball wheel assemblies and a skid covering a portion of the luggage face according to the disclosed subject matter, with portions broken away.

For the purpose of explanation and illustration, and not limitation, an exemplary embodiment of a piece of luggage 10 having ball wheel assemblies 100 and a skid 90 according to the disclosed subject matter is shown in FIG. 9. In this embodiment, a skid 90 can be disposed on the face 30 of the luggage body 20. The skid 90 can cover about half of the face 30, extending from the first edge 35 of the face. The skid 90 can be made of plastic, or any other suitable material, and can have mounting holes 92 to receive fasteners 210. For example and without limitation, the outer cover portion 140 of the top housing cover 145 can be placed on an inner surface 40 of the luggage body 10, with the skid 90 disposed on a portion of the outer surface 50. The top housing cover 145 can be secured to the legs 126, 136 by fasteners 210 through the outer cover portion 140 of the top housing cover 145 and the skid 90, with the face 30 of the luggage body 20 secured therebetween. In this embodiment, the skid 90 can replace inner mounting portion 150 to secure ball wheel assemblies 100 to the face 30 of the luggage body 20 in accordance with any of the wheel assembly configurations described above.

Figure 10:
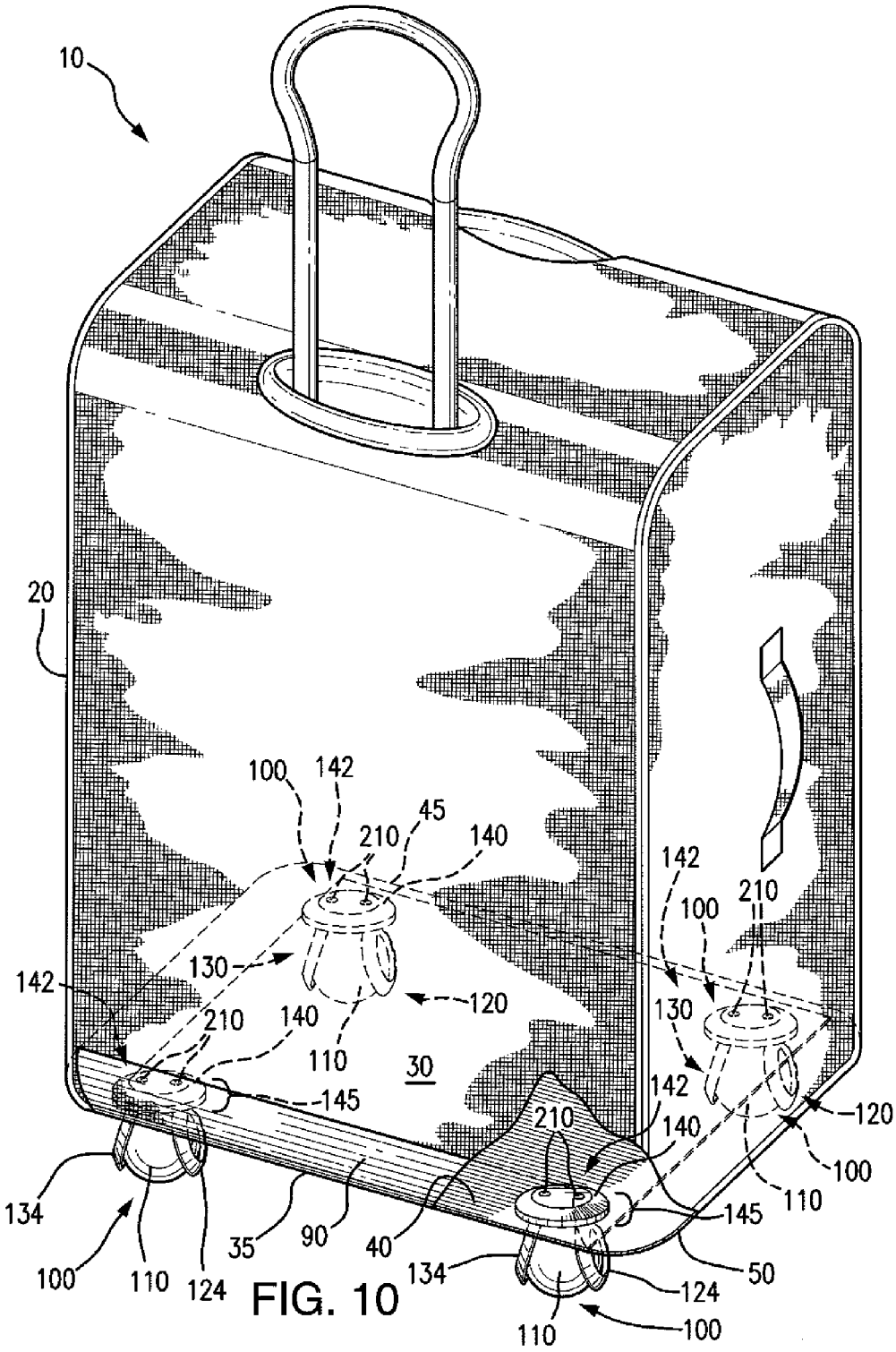
FIG. 10 is a schematic three-quarter front pictorial view of an exemplary embodiment of a piece of luggage including at least two ball wheel assemblies and a skid covering substantially all of the luggage face according to the disclosed subject matter, with portions broken away.

For the purpose of explanation and illustration, and not limitation, an exemplary embodiment of a piece of luggage 10 having ball wheel assemblies 100 and a skid 90 according to the disclosed subject matter is shown in FIG. 10. In this embodiment, a skid 90 can be disposed on the face 30 of the luggage body 20. The skid 90 can cover substantially all of the face 30. The skid 90 can be made of plastic, or any other suitable material, and can have mounting holes 92 to receive fasteners 210. For example and without limitation, the outer cover portion 140 of the top housing cover 145 can be placed on an inner surface 40 of the luggage body 10, with the skid 90 disposed on a substantial portion of the outer surface 50. The top housing cover 145 can be secured to the legs 126, 136 by fasteners 210 through the outer cover portion 140 of the top housing cover 145 and the skid 90, with the face 30 of the luggage body 20 secured therebetween. In this embodiment, the skid 90 can replace inner mounting portion 150 to secure ball wheel assemblies 100 to the face 30 of the luggage body 20 in accordance with the configurations described above. Alternatively, the skid 90 can replace inner mounting portion 150 to secure feet 60 to the face 30 of the luggage body 20 in accordance with the configurations described above.

While the disclosed subject matter is described herein in terms of certain exemplary embodiments, those skilled in the art will recognize that various modifications and improvements can be made to the disclosed subject matter without departing from the scope thereof. As such, the particular features claimed below and disclosed above can be combined with each other in other manners within the scope of the disclosed subject matter such that the disclosed subject matter should be recognized as also specifically directed to other embodiments having any other possible permutations and combinations. It will be apparent to those skilled in the art that various modifications and variations can be made in the systems and methods of the disclosed subject matter without departing from the spirit or scope of the disclosed subject matter. Thus, it is intended that the disclosed subject matter include modifications and variations that are within the scope of the appended claims and their equivalents.

What is claimed is:

1. A ball wheel assembly comprising:

a wheel ball;

first and second legs comprising:

a leg housing having a mounting portion and a ring-shaped leg cover, wherein the legs are secured together proximate to the mounting portions, a leg ball bearing retaining ring and leg ball bearings, wherein the leg ball bearing retaining ring and leg ball bearings are positioned between the leg cover and the wheel ball, wherein the leg cover has an inner circumference defining an inner diameter and an outer circumference defining an outer diameter, the inner diameter being between about one-half to about three-quarters the outer diameter, and wherein the leg cover has an inner surface, the inner surface being concave relative to the wheel ball; and a top housing comprising:

a top housing cover secured to the legs.

2. The ball wheel assembly of claim 1, wherein the inner diameter is about two-thirds the outer diameter.

3. The ball wheel assembly of claim 1, wherein the dimensions of the first and second legs are substantially identical.

4. The ball wheel assembly of claim 1, wherein the first and second legs are secured together with fasteners.

5. The ball wheel assembly of claim 4, wherein the first and second legs each have at least one mounting hole, each mounting hole being formed to securably receive the fasteners.

6. The ball wheel assembly of claim 4, wherein at least one of the first and second legs has a threaded mounting hole to securably receive one of the fasteners.

7. The ball wheel assembly of claim 4, wherein the first and second legs each have a mounting hole formed to securably receive a fastener and a further mounting hole formed to allow a further fastener to pass through the further mounting hole.

8. The ball wheel assembly of claim 1, wherein the inner surface of the leg cover has a curvature approximately equal to a curvature of the wheel ball.

9. The ball wheel assembly of claim 1, wherein the leg cover is positioned to provide a space between the leg cover and the wheel ball to permit dirt to escape from between the leg cover and the wheel ball.

10. The ball wheel assembly of claim 9, wherein the spacing is defined by a diameter of the leg ball bearings.

11. The ball wheel assembly of claim 1, wherein a cross-section of the wheel ball coplanar with the outer circumference of the leg cover has a diameter between about one-half to about five-sixths the diameter of the wheel ball.

12. The ball wheel assembly of claim 1, wherein a cross-section of the wheel ball coplanar with the outer circumference of the leg cover has a diameter of about three-fourths the diameter of the wheel ball.

13. The ball wheel assembly of claim 1, wherein each leg ball bearing is spaced apart a distance of about 2 mm from a proximate leg ball bearing at a minimum.

14. The ball wheel assembly of claim 1, wherein the top housing cover comprises an outer cover portion and an inner mounting portion.

15. The ball wheel assembly of claim 14, wherein the outer cover portion is made of plastic.

16. The ball wheel assembly of claim 14, wherein the inner mounting portion is made of forged aluminum.

17. The ball wheel assembly of claim 14, wherein the inner mounting portion is a skid.

18. The ball wheel assembly of claim 1, the top housing comprising a housing ball bearing retaining ring, and housing ball bearings, wherein the housing ball bearing retaining ring and housing ball bearings are positioned between the top housing cover and the wheel ball.

19. The ball wheel assembly of claim 1, wherein the top house is secured to the legs with fasteners through the top housing cover and the mounting portions.

20. The ball wheel assembly of claim 1, wherein the largest clearance between the ground and a portion of the leg cover nearest the ground when the wheel ball is in contact with the ground is between about ⅜ inches and ¾ inches.

21. The ball wheel assembly of claim 1, wherein at least one leg cover flares out from the mounting portion.

22. The ball wheel assembly of claim 21, wherein the at least one leg cover flares out about 20 degrees from a line perpendicular to the top housing.

23. A piece of luggage comprising:

a luggage body, and two ball wheel assemblies, each ball wheel assembly comprising:

a wheel ball;

first and second legs comprising:

a leg housing having a mounting portion and a ring-shaped leg cover, wherein the legs are secured together proximate to the mounting portions, a leg ball bearing retaining ring and leg ball bearings, wherein the leg ball bearing retaining ring and leg ball bearings are positioned between the leg cover and the wheel ball, wherein the leg cover has an inner circumference defining an inner diameter and an outer circumference defining an outer diameter, and wherein the leg cover has an inner surface, the inner surface being concave relative to the wheel ball; and a top housing comprising:

a top housing cover secured to the legs, wherein the two ball wheels are positioned on a surface of the luggage body along a first side.

24. The piece of luggage of claim 23, further comprising two feet positioned along a second side opposite the first side.

25. The piece of luggage of claim 23, further comprising two further ball wheel assemblies positioned along a second side opposite the first side.

* * * * *